US005975229A

United States Patent [19]

Hosoda

[11] Patent Number: 5,975,229

[45] Date of Patent: Nov. 2, 1999

[54] STAND-ON TRANSPORTATION DEVICE

[76] Inventor: Kiyoyuki Hosoda, 733-3, Ohaza Meisei, Misato-mura, Minamiazumi-gun, Nagano 399-8101, Japan

[21] Appl. No.: 09/059,403

[22] Filed: Apr. 14, 1998

[30] Foreign Application Priority Data

Jun. 10, 1997 [JP] Japan ..... 9-151917

[51] Int. Cl.[6] ..... A63C 5/08

[52] U.S. Cl. ..... 180/181; 180/180; 280/87.041; 280/87.042

[58] Field of Search ..... 180/180, 181, 180/309; 280/87.01, 87.041, 87.042, 87.021, 782

[56] References Cited

U.S. PATENT DOCUMENTS

| | | | |
|---|---|---|---|
| 1,070,468 | 8/1913 | Henley | 280/87.041 |
| 2,474,946 | 7/1949 | Kinslow | 280/87.042 |
| 3,135,347 | 6/1964 | Vranyosovics | 280/782 |
| 4,069,881 | 1/1978 | Shiber | 180/181 |
| 4,094,372 | 6/1978 | Notter | 180/181 |
| 4,181,316 | 1/1980 | Brand et al. | 280/87.042 |
| 4,821,832 | 4/1989 | Patmont | 280/87.041 |
| 5,127,488 | 7/1992 | Shanahan | 180/181 |
| 5,775,452 | 7/1998 | Patmont | 280/87.041 |

FOREIGN PATENT DOCUMENTS 6-23087 4/1992 Japan .

*Primary Examiner*—Lanna Mai
*Assistant Examiner*—James S. McClellan
*Attorney, Agent, or Firm*—Burns, Doane, Swecker & Mathis LLP

[57] ABSTRACT

The stand-up transportation device according to this invention comprises the shafts to which the front wheel and the rear wheel are assembled respectively, and the frame connecting these shafts. This transportation device also has the drive equipment that can drive the wheels on the shafts. Therefore, the user can run on a plane, an ascending slope or a rough road standing on the frame of this automatic transportation device as when they rides on a snowboard and the like, and changing the course by shifting the weight. As the transportation device is made of the shafts and the frame combined in a simple way, the user can readily enjoy riding on it at any time and anywhere. And the user can enjoy the drive feeling as they ride on a snowboard and the like without snow. Also, they can enjoy riding on it for a long distance or time.

6 Claims, 4 Drawing Sheets

STAND-ON TRANSPORTATION DEVICE

BACKGROUND OF INVENTION

1. Technical Field

This invention relates to a stand-on transportation device on which a rider can stand as in the case of a snowboard and which can run automatically by means of a drive device.

2. Description of the Related Art

There has known a skateboard that a rider standing can run in a desired direction by putting rider's feet on the board supported by rollers and keeping balance. There has also known a snowboard that a rider standing with rider's feet on the board and can slide down the snow slope.

The course of a skateboard can be changed by the shift of the rider's weight. Although a skateboard is a handy apparatus with simple structure, it is mostly used in an exclusive area such as a half pipe because the driving force can be obtained on a slope. When the riders ride on a skateboard on a plane ground, they must accelerate the skateboard by kicking the ground with one foot to obtain driving force. The riders are required powers to keep their balance on the board as well, and to move the skateboard. Therefore, it is difficult to ride on a skateboard for a long time or a long distance. Also the rider required having some skill and physical strength to go over the roughness and slight level differences on a road by skateboard.

The course of a snowboard can also be changed by the shift of the rider's weight and the rider can ride on it in an exclusive snow area such as a half pipe. The rider can enjoy riding on a snowboard in a spacious skiing ground sliding down the snow slope on it by keeping balance. However, it is impossible to ride on a snowboard in summer season because there is no snow.

The object of this invention is to provide a stand-on transportation device whose course the rider standing can change by shifting rider's weight as in the case of a skateboard and a snowboard, which the rider can run on a plane ground comfortably for a long time, and which can easily go over the roughness and slight level differences of a road. Another object of this invention is to provide a stand-on transportation device which can climb a slope. Still another object is to provide a stand-on transportation device having an appropriate operating condition for the rider so as to they exhaust little even if they ride on it outdoors or for a long time.

SUMMARY OF THE INVENTION

A stand-on transportation device according to this invention comprises two pairs of wheels placed in front and in rear; two shafts to which these wheels are rotatably attached; a frame which is connected approximately to the middle of the shafts through connectors moving elastically with respect to the shafts and having at least one footboard on which at least one rider (user) can stand; a drive device supported by at least one of the shafts; and a transmission which transmits the rotational force of the drive to at least one of the wheels attached to the shafts supporting the drive through at least one driving belt.

This stand-on transportation device (henceforth transportation device) has drive device such as an engine, a motor and the like, for driving a wheel or wheels. Therefore, the riders can enjoy riding on it without consuming their power by kicking the ground. In addition, since the transportation device can change the course by shifting rider's weight as a skateboard and a snowboard, they enjoy the drive feeling like a skateboard or a snowboard.

Unlike a skateboard or a snowboard whose main part is a board, the transportation device according to this invention has two shafts and a frame connecting these shafts. Therefore, the transportation device is lightweight and has sufficient strength for supporting engine and for driving. Since the frame is connected with the shafts by means of elastically moving connector, shafts can be turned by the shift of load on the footboards mounted on the frame. In addition, unlike a skateboard which has wheels under the board, the transportation device according to this invention can mount large diameter wheels on the end of shafts. Therefore the transportation device can easily run over uneven places which is rough and has level differences.

For the purpose of transmitting driving force to the wheels without disturbing the light and simple combination of the shafts and the frame which enables the user to change the course by shifting user's weight, the transportation device according to this invention has a transmission which transmits the rotational force of the drive not through a drive shaft but through a driving belt. The angle between the shafts and the frame varies when the user shifts the weight. Therefore, the drive device is mounted on at least one of the shafts, not on the frame, and drive at least one of the wheels attached to the shafts supporting the drive device so that the distance to be connected by the driving belt is kept constant. Accordingly, the driving belt does not come off or get loose, and the driving force can be transmitted to the wheels without fail even when the course of the transportation device is changed (rotated). Owing to the above arrangement, the drive device and/or the transmission do not interfere with connection between the shafts and the frame, thus this drive system does not prevent the user from controlling the course by shifting use's weight. The user can ride on this automatic transportation device comfortably on a plane or outdoors and change the course smoothly by shifting their weight.

Particularly, in the transportation device of this invention, the user can ride on almost the middle of the frame body including the shafts and the frame, to shift the weight. Therefore, the user can enjoy the feeling mostly like riding on a snowboard. Moreover, since the transportation device can drive by large diameter wheel using the power of the engine, the user can enjoy riding on the transportation device shifting their weight on a rough road and a wasteland.

By supporting a control lever of the drive by means of a flexible member extending above the drive, it becomes possible for the rider standing on the footboards to control the drive device in a comfortable position. As the flexible member supports the control lever, the user's arms are not strained much and the user does not get tired much even if they ride on the transportation device for a long time.

If the drive device is a combustion engine, it is possible to use the shafts supporting the drive device as an exhaust pipe.

By placing springs and dampers on both sides of the frame in the connector in a way that the springs and dampers support the frame with respect to the shafts, it is possible to transmit the movement of the frame to the shafts and turn the shafts for steering. Using the combined springs and dampers, it is possible to prevent a reactive shock caused by the shift of the user's weight or to reduce the impact caused by the roughness of a road and the like. Therefore it is possible to provide a transportation device which is more controllable and easy to ride.

By providing the connector with a sliding member (friction member) which can control the rotation force of the frame caused by the right and left change in load of the footboards, it is possible to adjust the efficiency of the transmission of the movement of the frame to the connector. Thus each user can operate the transportation device depending on their conditions or road conditions. In addition, by setting connecting parts of the frame at upward about 45 degrees to a horizontal part of the frame, it is possible for the user to enjoy a sharp feeling when steering the transportation device.

DESCRIPTION OF THE PREFERRED EMBODIMENT

Figure 1:
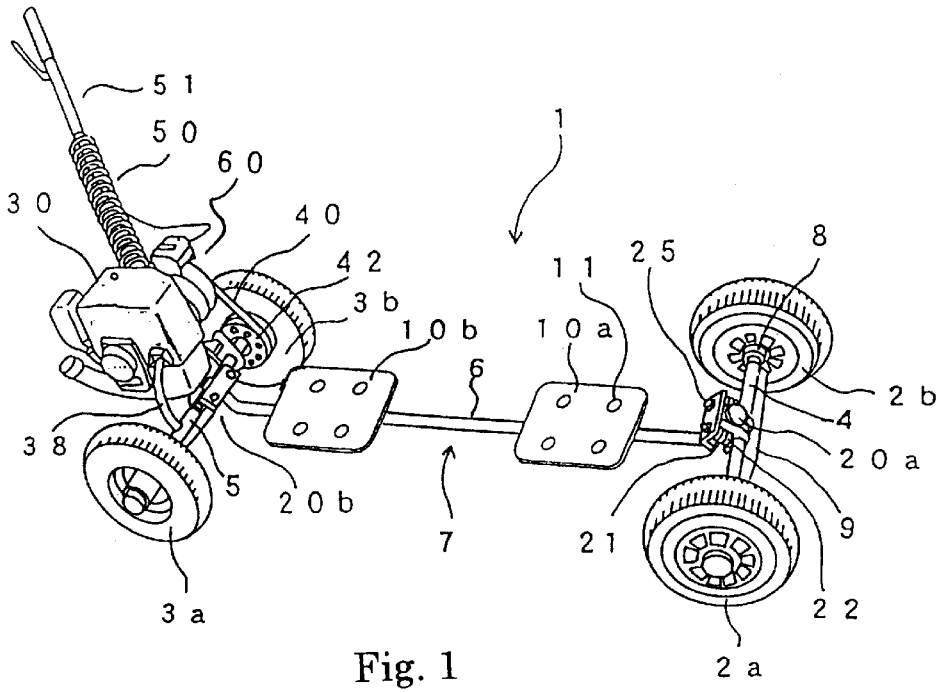
FIG. 1 is a perspective view of the exterior of the stand-on transportation device according to an embodiment of this invention.
Figure 2:
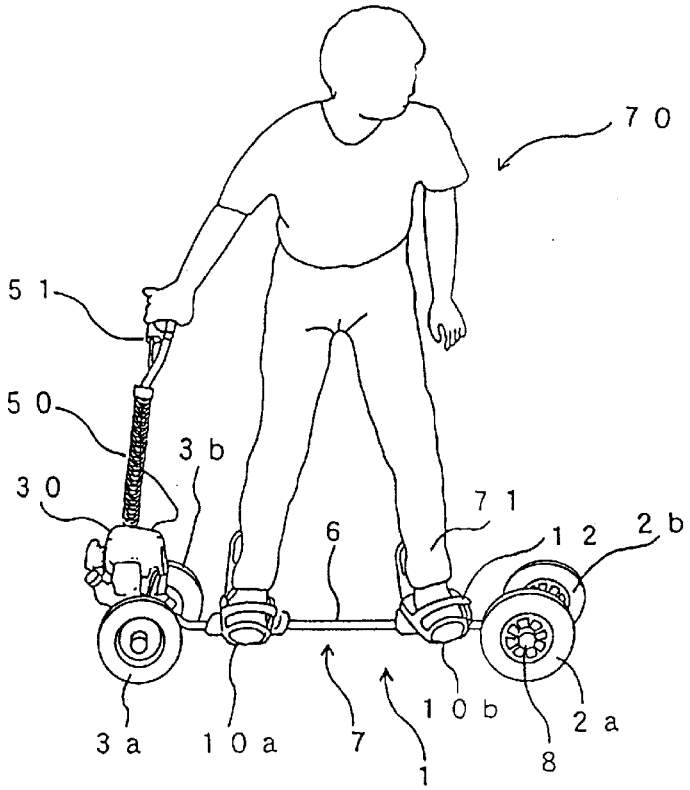
FIG. 2 shows the state in which the rider (user) stands on the transportation device shown in FIG. 1.
Figure 3:
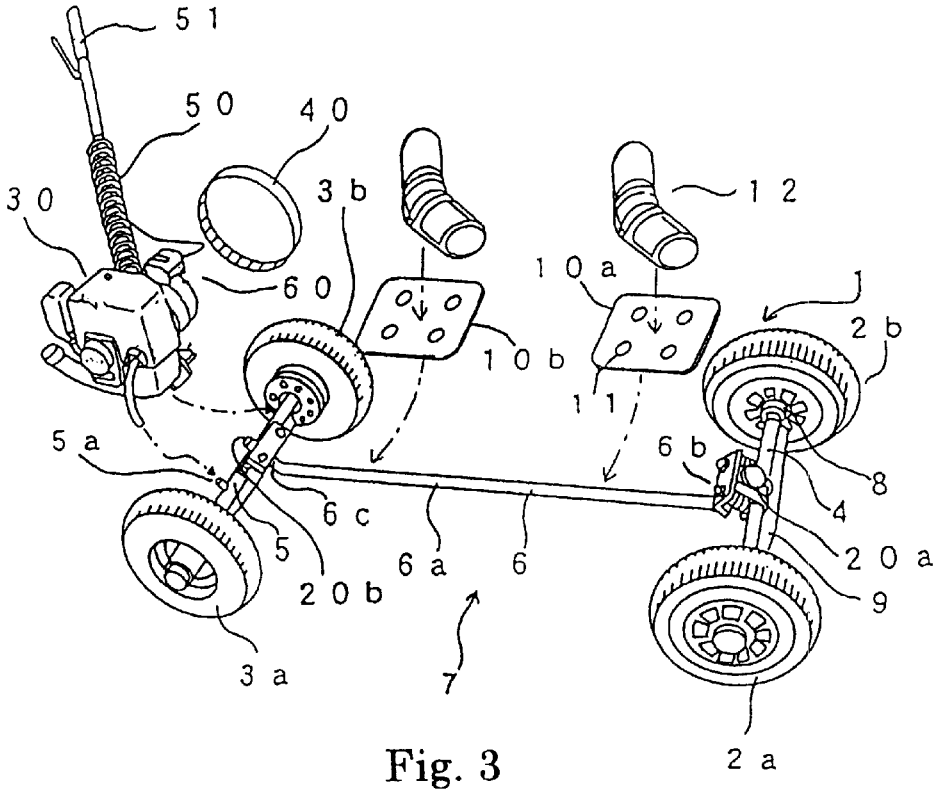
FIG. 3 is an exploded perspective view of the main members of the transportation device shown in FIG. 1.

FIG. 1 is a schematic view of a transportation device according to this invention, and FIG. 2 shows how a user rides on a transportation device 1. FIG. 3 is an exploded view of the schematic configuration of the transportation device 1 of this embodiment. The transportation device 1 of this embodiment comprises two pairs of wheels 2*a* and 2*b*, 3*a* and 3*b* placed in front and in rear; pipe-shaped shafts 4 and 5 connecting these pairs of wheels respectively; and a pipe-shaped frame 6 connecting the shafts 4 and 5. These two shafts 4 and 5, and the frame 6 are combined in approximately "H" shape to form a frame body 7. The front wheels 2*a* and 2*b* are rotatably attached to the front shaft 4 by a bearing 8, the rear wheels 3*a* and 3*b* are similarly attached to the rear shaft 5. Stiffening plates 9 are attached to the shafts 4 and 5 lengthwise to increase the strength thereof, so that the transportation device 1 may have enough strength for the user to ride on the frame 6 and run on a rough road.

A small gasoline engine 30 having a displacement of about 30 to 50 cc, but not limited, is mounted on the rear shaft 5. The rotational force of the engine 30 is transmitted to the rear wheel 3*b* through a driving belt 40, and the driving force of the engine 30 enables the transportation device 1 to run. A supporting member 50, which can move flexibly by means of a flexible tube or a coiled metal members, extends above the engine 30. A control lever 51 is attached to the tip of the supporting member 50, which enables the user to operate the engine 30 standing condition on the frame 6.

Figure 4:
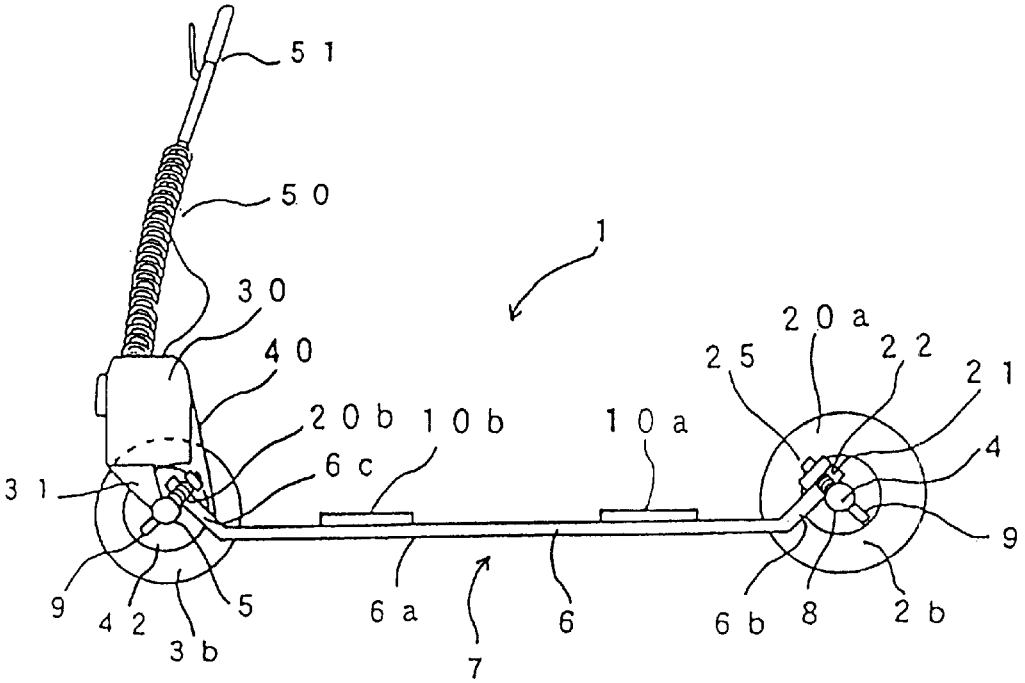
FIG. 4 is a lateral sectional view of the transportation device shown in FIG. 1.

The frame 6 extends longitudinally to connecting with the middle of the shafts 4 and 5 and it is made of a pipe-shaped member whose middle portion 6*a* extends horizontally. The front end 6*b* and the rear end 6*c* of the frame 6 incline upward at an angle of approximately 45 degrees to the horizontal middle portion 6*a*, and are connecting parts to the shafts 4 and 5. Accordingly, as the longitudinal view of the transportation device 1 of this embodiment in FIG. 4 shows, the frame 6 is positioned lower than the shafts 4 and 5, which makes it possible to form the stable frame body 7 whose center of gravity is low. Since the shafts 4 and 5 can be set higher than the frame 6, it is possible to attach wheels with a large diameter without heightening the center of gravity of the frame body. Therefore, the transportation device 1 can run even on a rough road smoothly.

Two footboards (decks) 10*a* and 10*b* are mounted to the middle portion 6*a* of the frame 6 in front and in rear. The user can ride on the transportation device 1 standing with user's feet on these footboards 10*a* and 10*b*. Holders 12, which can hold the feet 71 of the user 70 in an appropriate position, can be attached to the footboards 10*a* and 10*b*. For that purpose, fixing holes 11 are prepared in the footboards in a way that the holders 12 may be attached at an appropriate angle. Accordingly, the users can attach the holders 12 to the footboards 10*a* and 10*b* at an angle and in a position convenient to them, and then ride on the transportation device 1 putting their feet 71 inside the holders 12. The user can adjust the load balance applied to the frame 6 and the shafts 4 and 5 by shifting their weight right, left or in any other appropriate direction standing on the footboards 10*a* and 10*b*. Thus the user can advance the transportation device 1 as user's likes.

Figure 5:
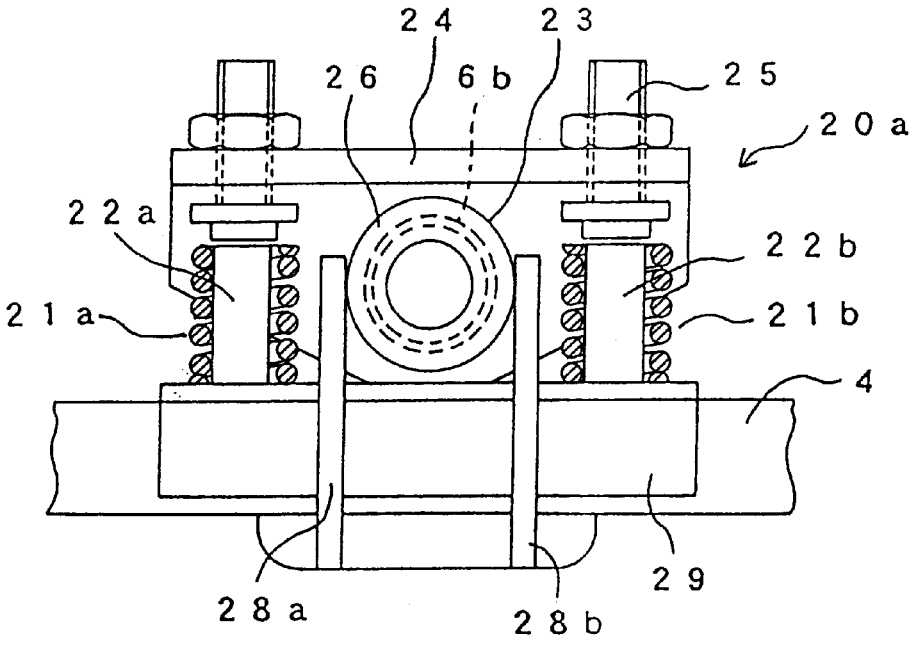
FIG. 5 is an enlarged front view of the connector of the transportation device shown in FIG. 1.
Figure 6:
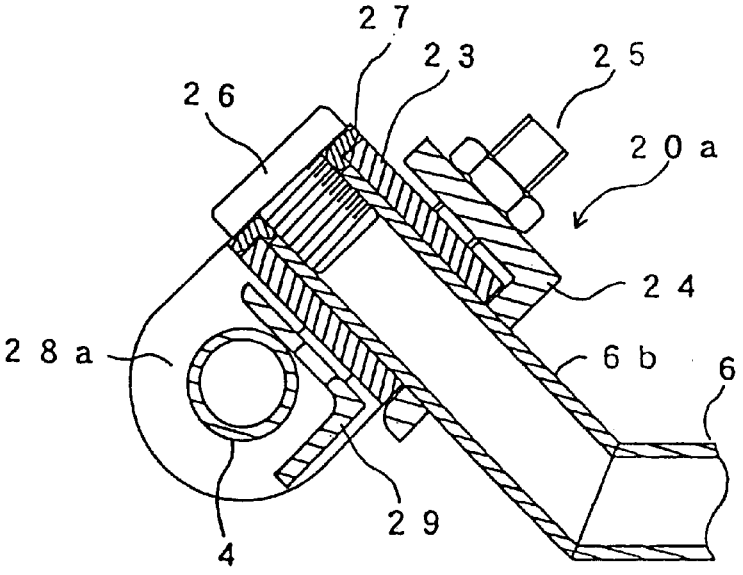
FIG. 6 is an enlarged lateral sectional view of the connector of the transportation device shown in FIG. 1.

In the transportation device 1 of this embodiment, the shafts 4 and 5 are connected to the frame 6 through connectors 20*a* and 20*b* that move elastically. Thus, the shafts 4 and 5 can rotate appropriately with respect to the frame 6 so that the movement of the frame 6 will cause the shafts 4 and 5 to change their direction for turning (steering). The connectors 20*a* and 20*b* of this embodiment, which join the frame 6 to the shafts 4 and 5, have the same structure. As shown in FIGS. 5 and 6, springs 21*a* and 21*b* are positioned on the right and left of the frame 6, and dampers (shock absorbers) 22*a* and 22*b* are positioned so as to overlap the springs 21*a* and 21*b* respectively.

The structure of the connectors 20*a* and 20*b* employed in the transportation device 1 of this embodiment will now be described in more detail taking one of the connector 20*a*. The connector 20*a* has a supporting pipe 23 in which the connecting part 6*b* of the frame 6 can be inserted, and a supporting fitting 24 having an L-shaped section being fixed on the supporting pipe 23. One end of the springs 21*a* and 21*b* and the dampers 22*a* and 22*b* is joined to the supporting fitting 24 through a clamping bolt 25, while the other end thereof is joined to a bearing fitting 29 attached to the middle portion of the shaft 4. Bearing plates 28*a* and 28*b* extend from the bearing fitting 29 in a way that the bearing plates 28*a* and 28*b* touch both sides of the supporting pipe 23 of the connector 20*a* so that the transverse movement of the supporting pipe 23 can be controlled and/or limited. Thus the joint 6*b* of the frame is inserted in the supporting pipe 23 of the joint 20*a* and then fixed therein. Then, the bearing plates 28*a* and 28*b* transmit the relative right and left movement of the frame 6 with respect to the shaft 4. While the relative up-and-down movement and the rotating movement (twisting movement) of the frame 6 with respect to the shaft 4 are transmitted by the springs 21*a* and 21*b*, and the dampers 22*a* and 22*b*.

In the connector 20*a*, when the user standing on the footboards 10*a* and 10*b* of the frame 6 twists the frame 6 by shifting user's weight right and left, the connecting part 6*b* of the frame 6 which extends at an angle of almost 45 degrees rotates. Then, one of the springs 21*a* and 21*b* shortens while the other lengthens accordingly. The shaft 4 rotates toward the loaded side (the side on which the user's weight is rested) according to the force given by the springs 21*a* and 21*b*, and thus it becomes possible to advance the frame body 7 in a desired direction. Therefore, as in the case of a skateboard and a snowboard, it is possible to change the course of the transportation device 1 of this invention easily by shifting the user's weight. As the springs 21*a* and 21*b* lengthen and shorten when the weight is shifted, there may occur a reaction. However, since the dampers 22*a* and 22*b* are attached to the connector 20*a* of this invention, the reaction is extremely small, and it is possible for the user to change the course of the transportation device smoothly even on a zigzag road.

When the transportation device runs on a rough road, as the impact can be absorbed by the combination of the springs 21*a* and 21*b* and the dampers 22*a* and 22*b* flexibly. Thus, since the shake of the transportation device may be reduced, the user standing on the footboards 10*a* and 10*b* is little affected, and can therefore enjoy running comfortably even when user runs on a rough road or rounds a curve. The properties of the springs 21*a* and 21*b* and the dampers 22*a* and 22*b* can be changed by the movement of a clamping bolt 25 according to the user's taste or the road conditions.

As shown by the section in FIG. 6, the rotating movement of the connecting part 6*b* of the frame inserted in the supporting pipe 23 is transmitted to the supporting pipe 23 through a sliding (friction) member 27 such as a rubber O ring, a packing and the like. The sliding member 27 is fixed to the tip 6*d* of the connecting part 6*b*. The sliding member 27 is elastically deformed by the tightening amount of a fitting bolt 26 to attach the connecting part 6*b* to the supporting pipe 23 to change the area of the portion of the sliding member 27 touching the connecting part 6*b* and the supporting pipe 23. Accordingly, adjusting the fitting bolt 26 changes the slippage (friction force) of the joint 6*b* in the supporting pipe 23, and the user can change how much the springs 21*a* and 21*b* of the joint 20*a* shorten or lengthen by shifting their weight. Thus the user can change the sharpness of steering (spinning or curving radius, feeling of course change, and the like) caused by the shift of the weight as user's likes or according to the road conditions.

The sharpness of the steering can change according to the angle of the connecting part 6*b*. By joining the frame 6 and the shaft 4 at about 45 degrees to a vertical line, it is possible to obtain an acute sharp steering according to the shift of the weight. Thus, the connecting part 6*b* is angled upward about 45 degrees from the horizontal middle part 6*a*.

Figure 7:
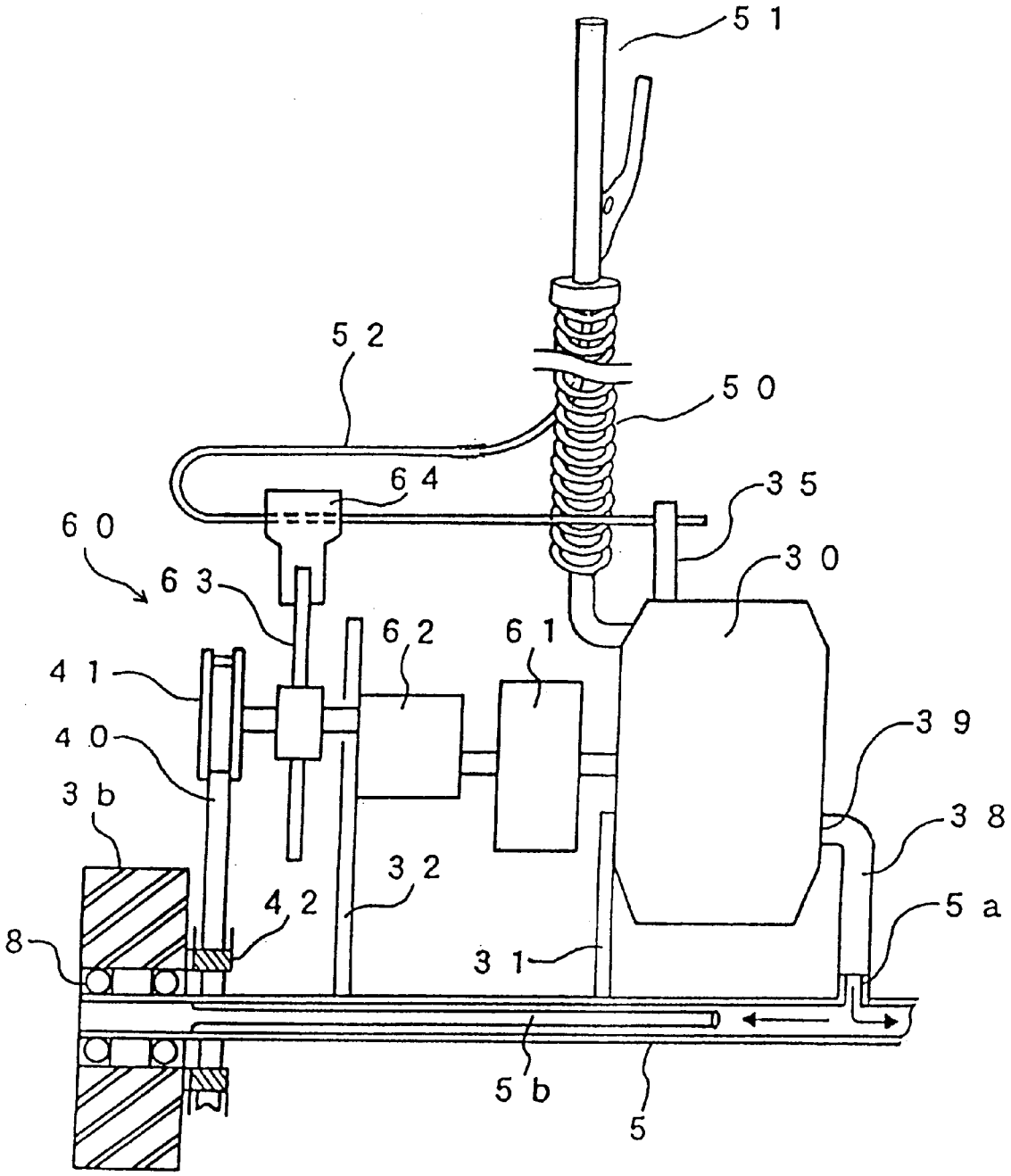
FIG. 7 is a schematic view of the surrounding configuration of the engine of the transportation device shown in FIG. 1.

Due to the above configuration of this transportation equipment 1, adjusting the fitting bolt 26 gives an operation feeling appropriate to the running ranging from sensitive operation feeling to moderately dull operation feeling. The connector 20*b* connecting the rear shaft 5 and the frame 6 has the same function. By connecting the frame 6 and the shafts 4 and by means of these two connectors 20*a* and 20*b*, the user standing on the transportation device can control the course sensitively by shifting the weight. And since the impact caused by the roughness of the road and the like can be absorbed, it is possible to provide the comfortable transportation device 1. In addition, as the extremely simple frame body 7 is employed which is made of the shafts 4 and 5 and the frame 6 combined approximately in an H shape, it is possible to provide the compact light transportation device 1 at a small cost. FIG. 7 schematically shows the surrounding configuration of the engine 30 fixed on the transportation device 1. The transportation device 1 has the gasoline engine 30, which is mounted to the rear shaft 5 by a support plate 31. The rotational force of the engine 30 is transmitted to one of the wheels 3*b* of the shaft 5 through a transmission 60 having a centrifugal clutch 61 which is connected when the number of revolutions increases, a one-way clutch 62 which transmits only forward driving force, a disc brake 63, and a driving belt 40. The transmission (transmission path) 60 having these centrifugal clutch 61, one-way clutch 62, disc brake 63, and driving belt 40, and a pulley 41 which rotates the driving belt 40 is also joined to the rear shaft 5 by a support plate 32. In the transportation device 1 of this embodiment, both the engine 30 and the transmission system 60 are attached to the rear shaft 5, and the wheel 3*b* of the rear shaft 5 is driven as a power wheel. Therefore, when the user riding on the frame 6 shifts the weight and the shaft 5 rotates, since the engine 30 and the transmission system 60 as well as the wheel 3*b* move according as the shaft 5 moves. Hence, the relative position of the wheel 3*b* with respect to the engine 30 and the transmission system 60 does not change, and thus the driving force of the engine 30 can be transmitted to the wheel 3*b* stably and continuously.

In the transportation device 1, the wheel 3*b* is rotated by the driving belt 40 fixed on a passive pulley 42 attached to the wheel 3*b*. Thus, the wheel 3*b* and the shaft 5 can be joined extremely simply through a bearing 8, and the shaft 5 need not be rotated like a drive shaft. Therefore, it is possible to load the engine 30 and the transmission system 60 weight on the shaft 5 directory. And the simple and light frame body 7 which can be operated comfortably and can be produced at a small cost by connecting the shaft 5 and the frame 6 by means of the connectors 20*b* as described above.

In addition, as the shaft 5 of the transportation device 1 of this example is made of pipe member, it can be pushed out of the wheel 3*b* through the bearing 8. Thus it is possible to exhaust the engine exhaust gas through the shaft 5 by connecting the shaft 5 to an exhaust port 39 of the engine 30, and the shaft 5 can be used as a noise eliminator (muffler). For that purpose, the shaft 5 of this example has a connecting port 5*a* for connecting the hollow inside to the exhaust port 39 of the engine by means of a vinyl pipe 38 and the like. It is also possible to make the shaft 5 function as a chamber by inserting a thin tube 5*b* in the shaft 5 on the exhaust side thereof, thereby further improving muffling efficiency.

The transportation device 1 of this example has the brake 63 not on the wheel 3*b* but in the transmission path 60 through which the power is transmitted from the one-way clutch 62 to the driving belt 40. Therefore the braking function can be added with the surrounding configuration of the wheel 3*b* kept simple, and it is possible to provide the safe transportation device 1 at a small cost without sacrificing the operating performance. It is also possible to brake the wheel 3*b* without fail by placing the brake downstream of the one-way clutch 62.

The disc brake 63 is operated by means of a control wire 52 extending from a control lever 51, which is supported above the engine 30 by a flexible member 50, to a brake pad 64. When the control lever 51 is open (being not held), the brake 63 works and stops the wheel 3*b*. While when the control lever 51 is held, the brake 63 is released and the wheel 3*b* begins to move. Accordingly, unless the user operates the control lever 51, the brake 63 is not released. Thus the brake 63 can function as a parking brake which prevents the transportation device from moving even on a slope and the like. Moreover, if the user standing on the frame 6 lets go of the control lever 51 losing his or her balance or by mistake, the brake works automatically and thus can prevent the transportation device 1 from speeding uncontrollably.

The control wire 52 extending from the control lever 51 is also joined to a throttle lever 35 of the engine 30 for operating the engine. When the control lever 51 is held, the number of revolutions of the engine 30 increases, while when the control lever 51 is open, the number of revolutions of the engine 30 decreases. Thus in the transportation device 1, when the control lever 51 is held, the brake 63 is released and the number of revolutions of the engine 30 increases. Then, the centrifugal clutch 61 is connected and transmits power to the wheel 3*b*, which causes the transportation device 1 to move. On the other hand, when the control lever 51 is open (being not held), the number of revolutions of the engine 30 decreases, and the centrifugal clutch 61 becomes disconnected and does not transmit power to the wheel 3*b*. Also, the control lever 51 is open, which causes the brake 63 to work and stop the transportation device 1. As can be seen above, it is possible to control the effectiveness of the brake 63 and the number of revolutions of the engine 30 at will by changing the grip amount (control input) of the control lever 51. Thus in the transportation device 1, an accelerator and the brake can be easily operated only by means of the control lever 51. In addition, the control lever 51 is supported by the flexible member 50 at a convenient height in a way that the user standing on the transportation device can hold the control lever by hand. Therefore, the user can shift the weight easily and smoothly at the stile standing and holding the control lever 51. Thus the user can control the transportation device 1 at will in a comfortable position.

As explained above, the steering of the transportation device 1 of this invention can be controlled by the shift of the rider's weight same the manner as the case of a skateboard and a snowboard. Particularly, as the user can change the course riding approximately in the middle of the frame body 7 by shifting the weight, the users can ride mostly like they ride on a snowboard. And as the user can control driving force and braking force by means of the control lever 51, they can run the transportation device of this invention at their will on a plane or an ascending slope by shifting the weight. Since the transportation device has the connectors that can absorb impact, and the wheel with a large diameter, it can run smoothly on a rough road, field, and wasteland. And as the transportation device absorbs impact effectively, the user can enjoy the stable off-road riding.

Because, in the transportation equipment 1 of this invention, the engine 30 can be mounted on the extremely simple and light frame body 7, even by a small engine the user can enjoy sufficient engine power to play. It is also possible to mount an engine with more output in order to improve running performance, and to design the transportation device of this invention two or four wheel drive type. And, it may be possible to hold down the gross weight of the transportation equipment to about 20 kg. The user can lift the transportation device by hands or they can carry the transportation device by car and the like to a place where to ride on it easily. Accordingly, the transportation device 1 can be used as leisure equipment or a sport apparatus, for example, a user who enjoys snowboarding in winter can also enjoy the transportation equipment of this invention in summer season. In addition, since this transportation device 1 enables the user to cover a certain distance comfortably standing on the footboards 10*a* and 10*b*, and does not occupy much space, it can be widely used as a transportation means and the like of one person or a small number of people who move in a certain area of places such as an amusement park, an airport building, and the like.

Although in the above embodiment the engine 30 is mounted on the rear shaft 5, it is possible to mount an engine on the front shaft 4 or on both the shafts. It is also possible to use an electric motor which is operated by a power supply from such as a battery, instead of an engine which burns liquid fuel. And although the transmission, which drives one of the wheels joined to the shafts, is used in this example, it goes without saying that the transmission can drive both of the wheels by means of driving belts through a differential gear and the like. And it is possible to omit the one-way clutch from the transmission.

The number of the footboards attached to the frame is not limited to two. It is possible to employ one footboard or deck on which a user can put both of use's feet, or three or more footboards so that a plurality of people can ride on the transportation device at the same time. The holders to hold the feet on the footboards need not be the type described in this example, or the holders can be dispensed with altogether. Although the pipe-shaped shafts and frame are used in the above embodiment, other members such as a channel member can be employed, and the frame and shafts can be made of a plurality of materials or members for the purpose of securing strength and the like.

As set forth above, the stand-up transportation device according to this invention comprises the shafts to which the front wheel and the rear wheel are assembled respectively, and the frame connecting these shafts. This transportation device also has the drive equipment that can drive the wheels on the shafts. The user can run on a plane, an ascending slope or a rough road standing on the frame of this automatic transportation device as when they rides on a snowboard and the like, and changing the course by shifting the weight. As the transportation device is made of the shafts and the frame combined in a simple way, the user can readily enjoy riding on it at any time and anywhere. And the user can enjoy the drive feeling as they ride on a snowboard and the like without snow. Also, they can enjoy riding on it for a long distance or time.

In this invention, the connectors, which connect the frame and the shafts, absorb the impact caused by the roughness of the road and the like by means of springs and dampers, and also reduce the shake caused by the shift of the weight and the like. Therefore the user can enjoy a sharp ride on the transportation device according to this invention easily and comfortably. The properties of the springs and dampers of the connector of this transportation device may be adjustable, or the transmission efficiency of the rotational force from the frame to the shafts may also be adjustable by means of the sliding member. Therefore, it is possible to set the operating conditions appropriate to each user.

I claim:

1. A stand-on transportation device comprising;

a front shaft and a rear shaft;

one pair of wheels rotatably attached to the front shaft;

one pair of wheels rotatably attached to the rear shaft;

a frame connected approximately to the middle of said shafts by connectors moving elastically with respect to said shafts and having at least one footboard on which at least one rider can stand;

a drive device supported by at least one of said shafts;

a transmission which transmits a rotational force of said drive device to one of said wheels attached to said one shaft supporting said driving device through at least one driving belt; and a control lever of said drive device, wherein the control lever includes a flexible member extending above said drive device for supporting the control lever above the drive device in a continuous upright manner.

2. A stand-on transportation device according to claim 1, wherein said drive device is a combustion engine, and at least one of said shafts supporting said drive function as an exhaust pipe.

3. A stand-on transportation device according to claim 1, wherein said connector has springs and dampers placed on both sides of said frame in a way that said springs and dampers support said frame with respect to said shafts.

4. A stand-on transportation device according to claim 1, wherein said connector has a sliding member for adjusting rotation force of said frame.

5. A stand-on transportation device according to claim 1, wherein connecting parts of said frame is inclined upward at about 45 degrees to a horizontal part.

6. A stand-on transportation device according to claim 1, wherein the one of the wheels attached to the one shaft is driven by the drive device and another of the wheels attached to the one shaft is freely rotatable.

* * * * *